US009709049B2

(12) United States Patent
Ueda et al.

(10) Patent No.: US 9,709,049 B2
(45) Date of Patent: Jul. 18, 2017

(54) PISTON DRIVE DEVICE

(71) Applicant: SHINANO KENSHI CO., LTD., Ueda-shi, Nagano (JP)

(72) Inventors: Kazuhiro Ueda, Ueda (JP); Eiji Okada, Ueda (JP)

(73) Assignee: SHINANO KENSHI CO., LTD., Ueda-shi (JP)

( * ) Notice: Subject to any disclaimer, the term of this patent is extended or adjusted under 35 U.S.C. 154(b) by 15 days.

(21) Appl. No.: 14/837,499

(22) Filed: Aug. 27, 2015

(65) Prior Publication Data

US 2016/0115949 A1 Apr. 28, 2016

(30) Foreign Application Priority Data

Oct. 23, 2014 (JP) ..... 2014-216475

(51) Int. Cl.
*F04B 27/04* (2006.01)
*F04B 35/04* (2006.01)
(Continued)

(52) U.S. Cl.
CPC ..... *F04B 39/0094* (2013.01); *F04B 27/0409* (2013.01); *F04B 27/0423* (2013.01);
(Continued)

(58) Field of Classification Search
CPC ..... F04B 27/02; F04B 27/04; F04B 25/00; F04B 39/0094; F04B 39/128; F04B 39/121; F04B 27/0409; F04B 27/0423; F04B 35/04; F04B 41/06; F04B 37/14; F01B 1/0634; F01B 1/0536
(Continued)

(56) References Cited

U.S. PATENT DOCUMENTS 1,478,929 A * 12/1923 Tursky ..... F04B 7/06 184/6
3,839,946 A * 10/1974 Paget ..... F04B 27/04 417/DIG. 1
(Continued)

FOREIGN PATENT DOCUMENTS

FR FR 346459 A * 1/1905 ..... F04B 25/00
JP 08338369 A * 12/1996
(Continued)

*Primary Examiner* — Nathan Zollinger
(74) *Attorney, Agent, or Firm* — Oliff PLC

(57) ABSTRACT

A piston drive device includes: a crankcase; first and second compression cylinders fixed to the crankcase; first and second vacuum cylinders fixed to the crankcase; a rotational shaft rotatably supported within the crankcase; first and second compression pistons connected to the rotational shaft and reciprocating respectively within the first and second compression cylinders; and first and second vacuum pistons connected to the rotational shaft and reciprocating respectively within the first and second vacuum cylinders; wherein each diameter of piston heads of the first and second compression pistons is smaller than each diameter of piston heads of the first and second vacuum pistons, and the first and second compression pistons are connected to the rotational shaft so as to sandwich the first and second vacuum pistons in an axial direction of the rotational shaft.

4 Claims, 6 Drawing Sheets

(51) Int. Cl.
*F04B 41/06* (2006.01)
*F04B 39/00* (2006.01)
*F04B 39/12* (2006.01)

(52) U.S. Cl.
CPC ..... *F04B 35/04* (2013.01); *F04B 39/121* (2013.01); *F04B 39/128* (2013.01); *F04B 41/06* (2013.01)

(58) Field of Classification Search
USPC ..... 417/269, 273; 91/472, 474; 92/72; 123/317, 318, 192.1, 52.3, 53.6
See application file for complete search history.

(56) References Cited

U.S. PATENT DOCUMENTS

| | | | | |
|---|---|---|---|---|
| 8,932,029 | B2 * | 1/2015 | Komatsu ..... | F01B 1/062 417/273 |
| 2004/0131489 | A1 | 7/2004 | Leu et al. | |
| 2016/0084243 | A1 * | 3/2016 | Feng ..... | F04B 37/02 15/250.001 |

FOREIGN PATENT DOCUMENTS

| | | | | |
|---|---|---|---|---|
| JP | 2005188492 | A | * | 7/2005 |
| JP | 2008095700 | A | | 4/2008 |

* cited by examiner

PISTON DRIVE DEVICE

CROSS-REFERENCE TO RELATED APPLICATION

This application is based upon and claims the benefit of priority of the prior Japanese Patent Application No. 2014-216475, filed on Oct. 23, 2014, the entire contents of which are incorporated herein by reference.

BACKGROUND (i) Technical Field

The present invention relates to a piston drive device.

(ii) Related Art

There is known a device in which plural pistons are connected to a rotational shaft and reciprocate. Japanese Patent Application Publication No. 2008-95700 discloses a related device.

For example, in a case where plural compression pistons and plural vacuum pistons different from each other in a diameter of a piston head are connected to the rotational shaft, the piston drive device might increase its size in the axial direction of the rotational shaft, depending on the order in which the compression pistons and the vacuum pistons are arranged.

SUMMARY

According to an aspect of the present invention, there is provided a piston drive device including: a crankcase; first and second compression cylinders fixed to the crankcase; first and second vacuum cylinders fixed to the crankcase; a rotational shaft rotatably supported within the crankcase; first and second compression pistons connected to the rotational shaft and reciprocating respectively within the first and second compression cylinders; and first and second vacuum pistons connected to the rotational shaft and reciprocating respectively within the first and second vacuum cylinders; wherein each diameter of piston heads of the first and second compression pistons is smaller than each diameter of piston heads of the first and second vacuum pistons, and the first and second compression pistons are connected to the rotational shaft so as to sandwich the first and second vacuum pistons in an axial direction of the rotational shaft.

DETAILED DESCRIPTION

Figure 1:
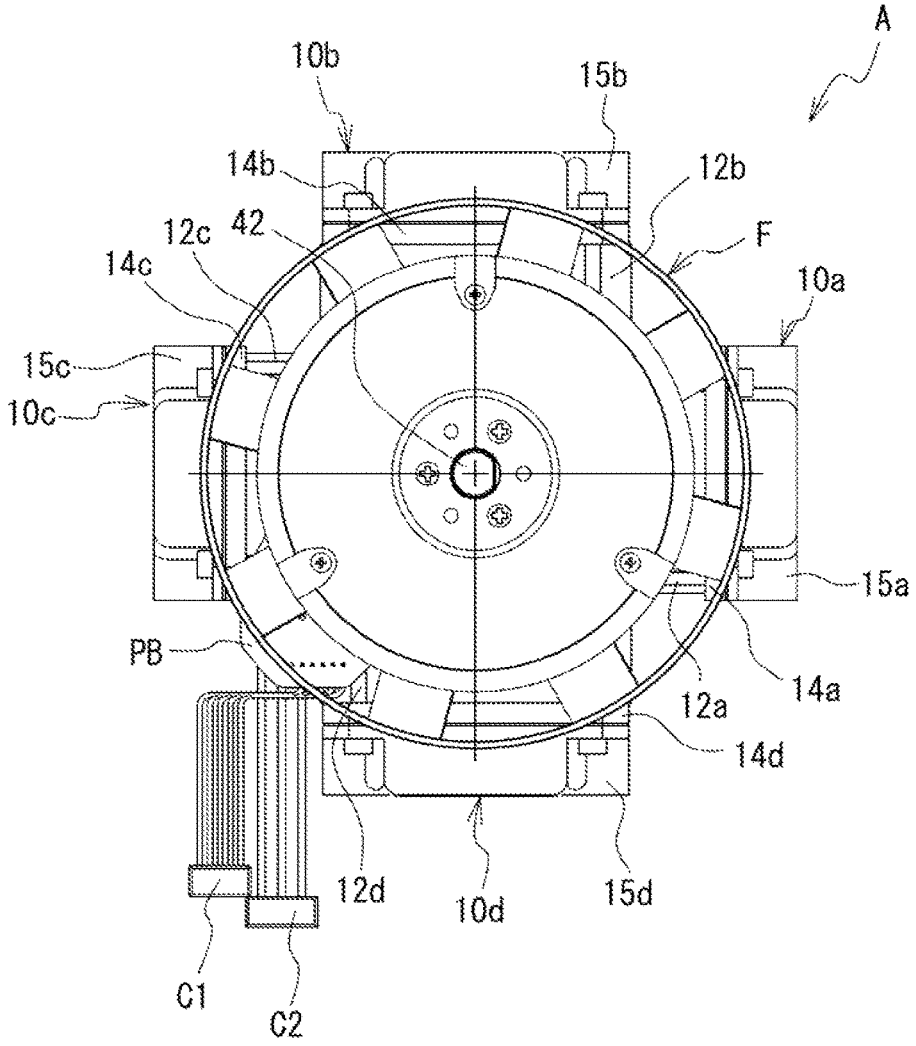
FIG. 1 is a front view of a vacuum machine.
Figure 2:
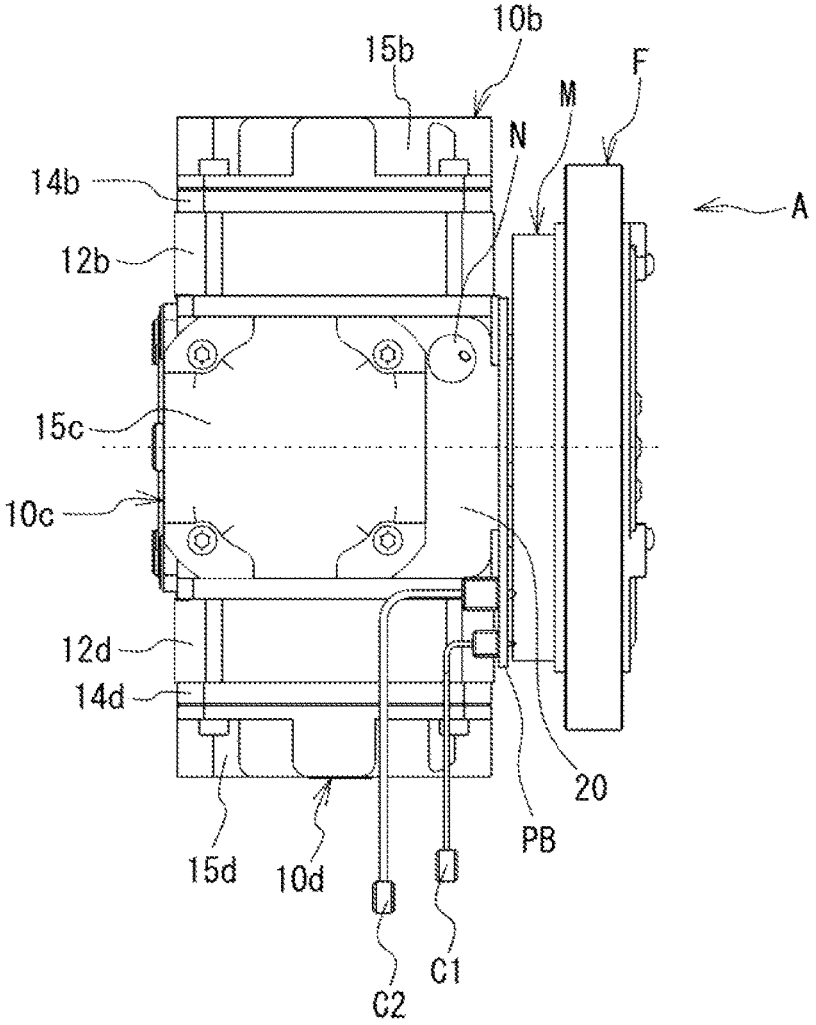
FIG. 2 is a side view of the vacuum machine.
Figure 3:
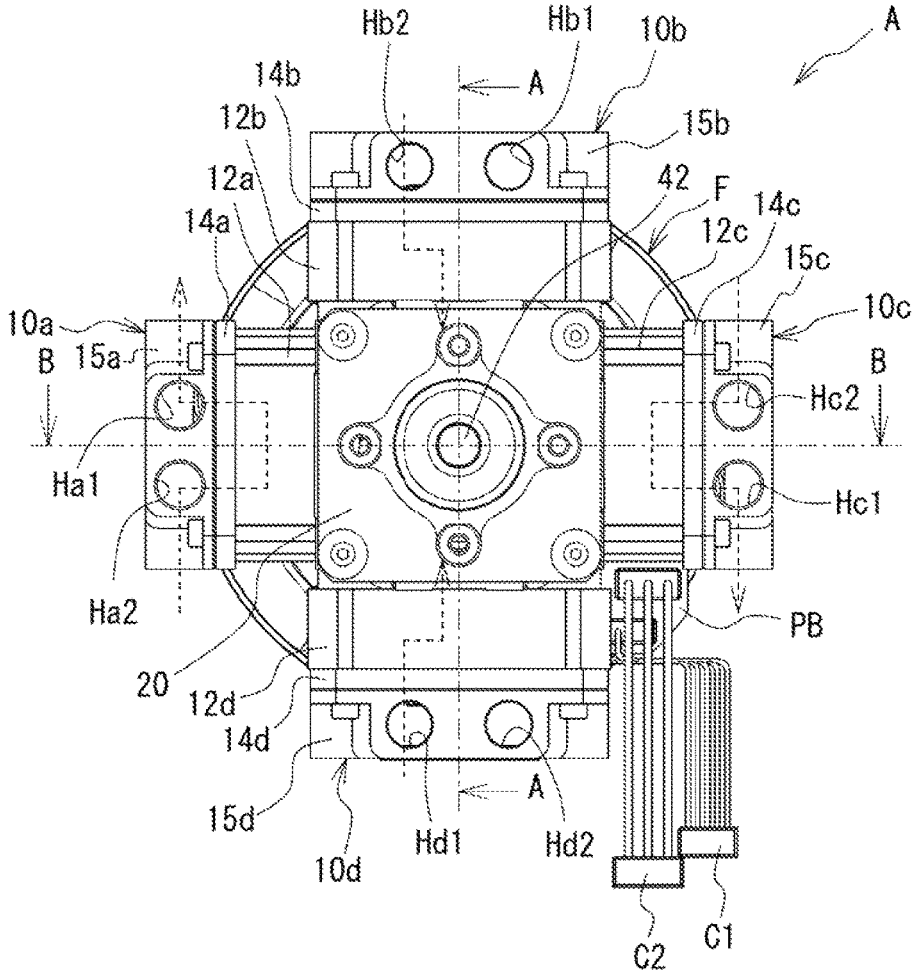
FIG. 3 is a rear view of the vacuum machine.

FIGS. 1, 2, and 3 are front, side, and rear views of a piston drive device A, respectively. The piston drive device A includes: four cylinders 10*a* to 10*d*; a crankcase 20 to which the four cylinders 10*a* to 10*d* are fixed; and a motor M arranged on an upper portion of the crankcase 20. The cylinders 10*a* to 10*d* are radially fixed around the crankcase 20. The cylinder 10*a* includes: a cylinder body 12*a* fixed to the crankcase 20; and a cylinder head 15*a* fixed to the cylinder body 12*a*. A partition plate 14*a* intervenes between the cylinder body 12*a* and the cylinder head 15*a*. Likewise, the cylinders 10*b* to 10*d* include cylinder bodies 12*b* to 12*d* and cylinder heads 15*b* to 15*d*, respectively. Between the cylinder bodies 12*b* to 12*d* and the cylinder heads 15*b* to 15*d*, partition plates 14*b* to 14*d* intervene, respectively. The cylinder 10*a* and the like and the crankcase 20 are made of metal such as aluminum with good heat radiation. A nozzle N is fixed to the crankcase 20. The nozzle N exhausts air introduced into the crankcase 20 to the outside. Also, apertures Ha1 and Ha2 are provided in the cylinder head 15*a*. Likewise, apertures Hb1, Hb2, Hc1, Hc2, Hd1, and Hd2 are provided in the cylinder heads 15*b* to 15*d*, respectively.

Figure 4:
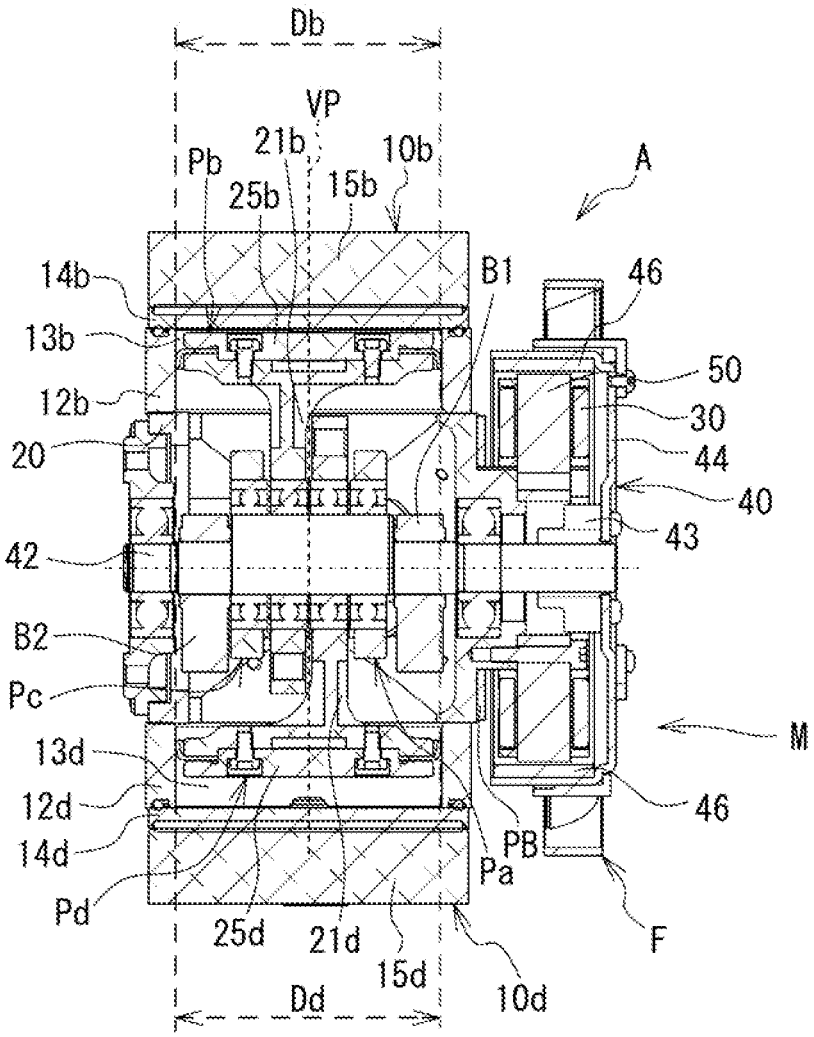
FIG. 4 is a sectional view taken along A-A line of FIG. 3.

FIG. 4 is a sectional view taken along A-A line of FIG. 3. The motor M illustrated in FIG. 2 includes coils 30, a rotor 40, a stator 50, and a printed circuit board PB. The stator 50 is fixed to the crankcase 20. Around the stator 50, plural coils 30 are wound. The coils 30 are electrically connected to the printed circuit board PB. Additionally, the printed circuit board PB is connected to connectors C1 and C2 through cables as illustrated in FIGS. 1 to 3. The stator 50 is excited by energizing the coils 30. The rotor 40 includes a rotational shaft 42, a yoke 44, and one or more permanent magnets 46. The rotational shaft 42 is rotatably supported by plural bearings arranged within the crankcase 20. The yoke 44 is fixed to the rotational shaft 42 through a hub 43, and the yoke 44 rotates with the rotational shaft 42. The yoke 44 has a substantially cylindrical shape, and is made of metal. One or more plural permanent magnets 46 are fixed to an internal circumferential surface of the yoke 44. The permanent magnet 46 faces an outer circumferential surface of the stator 50. The stator 50 is excited by energizing the coils 30. Thus, the magnetic attractive force and the magnetic repulsive force exert between the permanent magnet 46 and the stator 50. This magnetic force causes the rotor 40 to rotate. Thus, the motor M is a motor of an outer rotor type in which the rotor 40 rotates.

A fan F is fixed to the yoke 44 of the rotor 40, and rotates with the rotor 40. Thus, the crankcase 20 and the cylinders 10*a* to 10*d* are cooled. Also, an increase in temperature depending on friction of movable portions can be suppressed.

As illustrated in FIG. 4, the fan F and the motor M are arranged in the radial direction of the fan F when viewed in the cross section including the axis of the motor M. Specifically, the fan F, the coils 30, the rotor 40, and the stator 50 are arranged in the radial direction of the fan F. Thus, for example, as compared with a case where the fan F is arranged at an end in the axial direction with respect to the motor M (the right side in FIG. 4) and is fixed to the end of the rotational shaft, the piston drive device A according to the present embodiment has a reduced thickness in the axial direction of the rotational shaft 42. Further, the fan F is close to the cylinders 10*a* to 10*d*, thereby improving the cooling effects.

Also, in a case where the fan F is arranged at the end in the axial direction with respect to the motor M and is fixed to the end of the rotational shaft, the rotational shaft has to be long. If the rotational shaft is long, it is necessary to provide a large bearing or plural bearings in order to support the rotation of the rotational shaft. In the piston drive device A according to the present embodiment, the short rotational shaft 42 is employed, thereby supporting the rotational shaft 42 by a small bearing or few bearings. Therefore, the whole weight of the piston drive device A is reduced.

Figure 5:
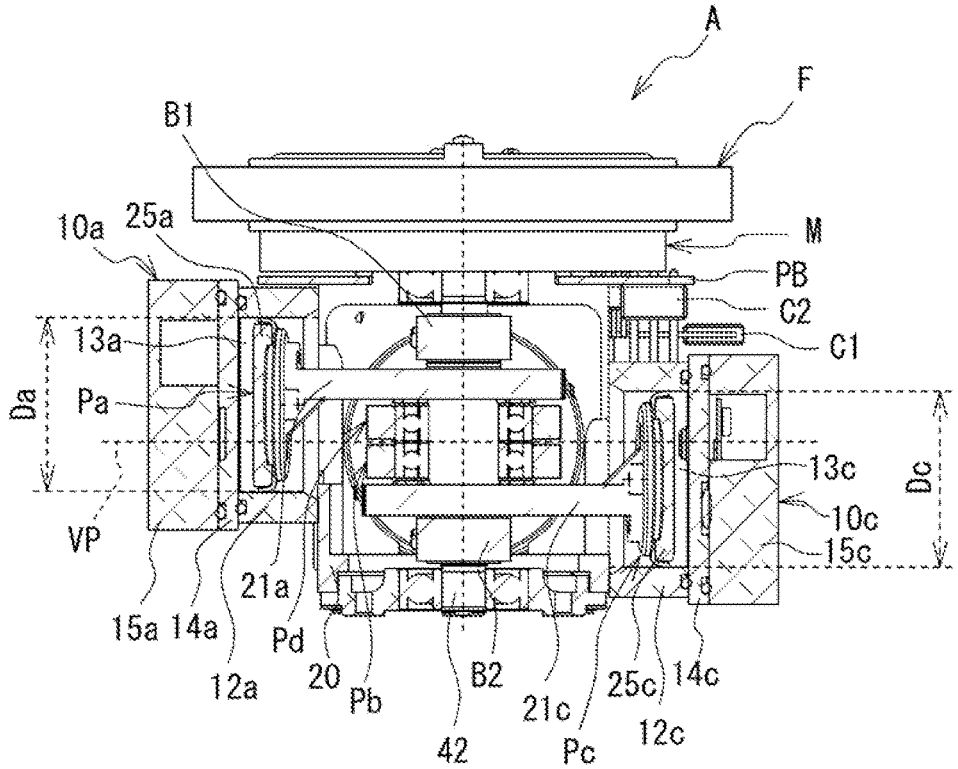
FIG. 5 is a sectional view taken along B-B line of FIG. 3.

FIG. 5 is a cross section taken along B-B line of FIG. 3. In addition, FIG. 5 does not illustrate a section of the motor M. As illustrated in FIG. 5, the cylinder body 12*a* is fixed to an outer peripheral wall of the crankcase 20 to communicate with a hole formed in the outer peripheral wall of the crankcase 20. Also, the cylinder head 15*a* is fixed to a distal end of the cylinder body 12*a* through the partition plate 14*a*. A chamber 13*a* is formed in the cylinder body 12*a*. The chamber 13*a* is defined by the cylinder body 12*a*, a piston head 25*a* of the piston Pa, and the partition plate 14*a*. The piston Pa reciprocates in conjunction with the rotation of the motor M, so a capacity of the chamber 13*a* increases and decreases. A proximal end of the piston Pa is located within the crankcase 20, and is coupled with the rotational shaft 42 receiving rotary power through a bearing from the motor M. Specifically, the proximal end of the piston Pa is coupled at the eccentric position with respect to the central position of the rotational shaft 42, and the piston Pa reciprocates in conjunction with the one-way rotation of the rotational shaft 42. Pistons Pb to Pd reciprocating within the other cylinders 10*b* to 10*d* are provided therewithin, respectively. As for these pistons, positional phases are shifted at intervals of 90 degrees. The piston Pa includes: a piston rod 21*a* having a root portion connected to the rotational shaft 42; and the piston head 25*a* fixed to the distal end of the piston rod 21*a* by a screw (not illustrated). Similarly, the pistons Pb to Pd respectively include piston rods 21*b* to 21*d* and piston heads 25*b* to 25*d*. Additionally, balancers B1 and B2 are fixed to the rotational shaft 42 and are not rotatable with respect thereto so as to sandwich the pistons Pa to Pd.

Here, the piston drive device A has a function as a compressor for sucking air from the outside and compressing the air and discharging the air to the outside, and a function as a vacuum machine for sucking air from the outside and discharging the air to the outside. Specifically, the cylinders 10*a* and 10*c* fixed to opposite sides of the crankcase 20 are examples of first and second compression cylinders, and the pistons Pa and Pc are examples of first and second compression pistons. Specifically, the reciprocation of the piston Pa introduces air into the chamber 13*a* through the opening Ha2 to compress the air within the chamber 13*a*, discharging the air outside the chamber 13*a*, which discharges the air outside the piston drive device A through the opening Ha1. Likewise, the reciprocation of the piston Pc introduces air into the chamber 13*c* through the opening Hc2 to compress the air within the chamber 13*c*, discharging the air outside the chamber 13*c*, which discharge the air outside the piston drive device A through the opening Hc1. FIG. 3 illustrates arrows indicating directions in which air flows in accordance with the reciprocation of the pistons Pa and Pc. The chambers 13*a* and 13*c* are examples of first and second compression chambers.

Further, the cylinders 10*b* and 10*d* fixed to opposite sides of the crankcase 20 are examples of first and second vacuum cylinders, and pistons Pb and Pd are examples of first and second vacuum pistons. Specifically, the reciprocation of the piston Pb sucks air into a chamber 13*b* through the opening Hb2 to discharges the air through the piston head 25*b* of the piston Pb into the crankcase 20 outside the chamber 13*b*, which discharge the air through the nozzle N to the outside. Likewise, the reciprocation of the piston Pd sucks air into a chamber 13*d* through the opening Hd1 to discharge the air through the piston head 25*b* of the piston Pd into the crankcase 20 outside the chamber 13*d*, which discharges the air through the nozzle N to the outside. As can be seen from FIGS. 2-5 and 6, the nozzle N funnels to the outside the collective air outflows expelled by the first and second vacuum pistons from the respective chambers 13*b*, 13*d* and into the crankcase 20. FIG. 3 illustrates arrows indicating directions in which air is sucked into the crankcase 20 from the outside by the reciprocation of the pistons Pb and Pd. The chambers 13*b* and 13*d* are examples of first and second vacuum chambers. The pistons Pb and Pd will be described later in detail.

As described above, the air compressed by the pistons Pa and Pc and the air sucked by the pistons Pb and Pd are discharged outside without meeting each other within the piston drive device A. Therefore, the piston drive device A itself has the functions as the compressor and as the vacuum machine.

Here, as illustrated in FIGS. 4 and 5, each of the diameters Da and Dc of the piston heads 25*a* and 25*c* of the pistons Pa and Pc of the compression pistons is smaller than each of the diameters Db and Dd of the piston heads 25*b* and 25*d* of the pistons Pb and Pd of the vacuum pistons. The reason for this is as follows. The pistons Pa and Pc of the compression pistons compress air and discharge the air to the outside, so a pressure per unit area on the piston heads thereof is relatively large. In contrast, the pistons Pb and Pd of the vacuum pistons do not compress air, so a pressure per unit area on the piston heads thereof is relatively small. Here, if there is a large difference between the force exerting on the pistons Pa and Pc and the force exerting on the piston Pb and Pd, the rotation shaft 42 might be adversely influenced. Therefore, in order to reduce such a difference, each of the diameters Da and Dc of the piston heads 25*a* and 25*c* of the pistons Pa and Pc is set smaller than each of the diameters Db and Dd of the piston heads 25*b* and 25*d* of the pistons Pb and Pd. Additionally, the diameters Da and Dc are the same, and the diameters Db and Dd are the same. The sizes of the cylinders 10*a* to 10*d* also are set corresponding to the diameters Da to Dd of the piston heads 25*a* to 25*d*, respectively. Specifically, the inner diameters of inner surfaces of the cylinder bodies 12*a* to 12*d* on which the piston heads 25*a* to 25*d* slide are substantially the same as the diameters Da to Dd, respectively.

Here, the pistons Pa and Pc are connected to the rotational shaft 42 so as to sandwich the pistons Pb and Pd. In other words, among the four pistons, the pistons Pa and Pc are arranged on the outermost sides. This is because, if at least one of the pistons Pb and Pd respectively having the relatively large diameters Db and Dd is arranged on the outermost side among the four pistons, the size of the device is increased in the axial direction of the rotational shaft 42. In this embodiment, the pistons Pa and Pc respectively having the relatively small diameters Da and Dc are arranged so as to sandwich the pistons Pb and Pd respectively having the relatively large diameters Db and Dd, thereby suppressing an increase in the size of the piston drive device A in the axial direction of the rotational shaft 42.

In addition, FIGS. 4 and 5 illustrate a virtual plane VP perpendicular to the rotation shaft 42. The virtual plane VP intersects the piston heads 25*a* to 25*d* of all of the pistons Pa to Pd. In other words, the pistons Pa to Pd are arranged close to one another such that the piston heads 25*a* to 25*d* of the pistons Pa to Pd intersect the virtual plane VP. In the pistons Pa to Pd closely arranged in this way, the pistons Pa and Pc are arranged so as to sandwich the pistons Pb and Pd, thereby suppressing the increase in the size of the piston drive device A in the axial direction of the rotational shaft 42.

Figure 6:
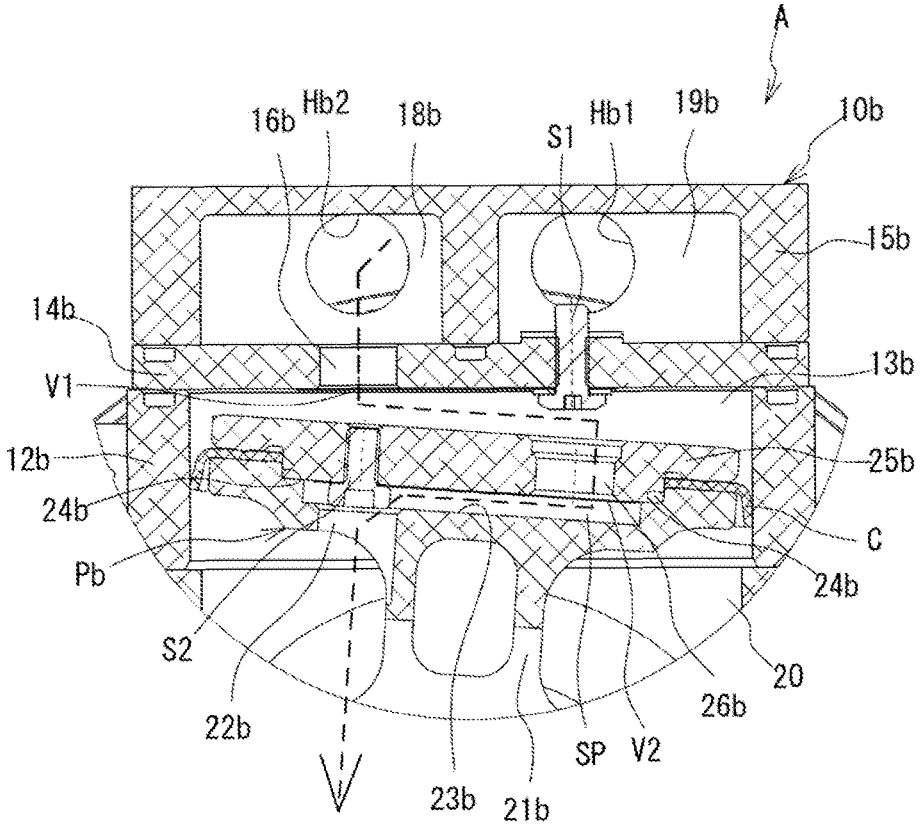
FIG. 6 is an explanatory view of a piston for vacuum.

Next, the structure of the piston Pb will be described. Additionally, the description of the piston Pd is omitted because it has the same structure as the piston Pb. FIG. 6 is an explanatory view of the piston Pb for vacuum. Further, FIG. 6 is a sectional view of the cylinder 10*b* viewed from the bottom surface of the piston drive device A. The cylinder head 15*b* includes: rooms 18*b* and 19*b* partitioned from each other; and the apertures Hb2 and Hb1 respectively communicating with the rooms 18*b* and 19*b*. The partition plate 14*b* is formed with a hole portion 16*b* communicating the room 18*b* with the chamber 13*b*. Note that the partition plate 14*b* is not formed with a through-hole communicating the room 19*b* and the chamber 13*b*. However, the through-hole communicating the room 19*b* with the chamber 13*b* may be formed and sealed.

A check valve V1 is fixed to the partition plate 14*b*. The check valve V1 allows air to flow into the chamber 13*b* through the hole portion 16*b* from the room 18*b*, but restricts air from flowing reversely. The check valve V1 is fixed to an inner surface of the partition plate 14*b* facing the piston head 25*b* by a screw S1. A proximal end of the check valve V1 is fixed to the partition plate 14*b* by the screw S1, a distal end of the check valve V1 is a free end, and the check valve V1 is elastically deformed to open and close the hole portion 16*b*. The check valve V1 is elastically deformed by a difference in inner pressure between the chamber 13*b* and the room 18*b*, so the hole portion 16*b* is opened and closed. The check valve V1 is arranged within the chamber 13*b*. The check valve V1 is made of metal such as a stainless steel, but is not limited to this.

The piston Pb includes: the piston rod 21*b* having a proximal end coupled with the rotational shaft 42; and the piston head 25*b* fixed to a distal end of the piston rod 21*b* by a screw not illustrated. A sealing ring C is sandwiched between the piston rod 21*b* and the piston head 25*b*. The sealing ring C seals between the piston Pb and an inner side surface of the cylinder body 12*b*, and is made of material such as fluoric resin with a good self-lubrication property.

A space SP is formed between the distal end of the piston rod 21*b* and the piston head 25*b*. Specifically, a recess portion 23*b* is formed in the distal end of the piston rod 21*b*, and a stepped portion 24*b* is formed around the recess portion 23*b*. The piston head 25*b* is fitted into and fixed to the stepped portion 24*b*. A through-hole 26*b* communicating with the space SP is formed in the piston head 25*b*. A through-hole 22*b* communicating with the space SP is formed in the piston rod 21*b*.

A check valve V2 is fixed to an inner surface, of the piston head 25*b* facing the recess portion 23*b* of the piston rod 21*b*, by a screw S2. The screw S2 is an example of a fixation member. A proximal end of the check valve V2 is fixed to the piston head 25*b* by the screw S2, a distal end of the check valve V2 is a free end, and the check valve V2 is elastically deformed to open and close the through-hole 26*b*. The check valve V2 is elastically deformed by a difference in inner pressure between the chamber 13*b* and the crankcase 20, so the through-hole 26*b* is opened and closed. The check valve V2 is provided within the space SP and is elastically deformable therewithin. The check valve V2 permits air to flow into the crankcase 20 through the through-hole 26*b*, the space SP, and the through-hole 22*b* from the chamber 13*b*, but restricts air from reversely flowing. The check valve V2 is made of metal such as stainless steel, but is not limited to this. The check valve V2 is a member that has a plate shape having a certain thickness so as to be elastically deformable.

When the reciprocation of the piston Pb causes the capacity of the chamber 13*b* to increase from the minimum to the maximum, air is introduced into the room 18*b* through the aperture Hb2 from the outside, and the distal end of the check valve V1 is elastically deformed to be bent away from the hole portion 16*b*, which opens the hole portion 16*b*. Thus, air is introduced into the chamber 13*b*. When the capacity of the chamber 13*b* decreases from the maximum to the minimum, the distal end of the check valve V2 is elastically deformed to be bent away from the through-hole 26*b* and opens the through-hole 26*b*, which introduces air from the chamber 13*b* to the crankcase 20 through the through-hole 26*b*, the space SP, and the through-hole 22*b*. Additionally, at this time, the check valve V1 is kept closing the hole portion 16*b* by the inner pressure of the chamber 13*b*. In this way, air is introduced into the crankcase 20 through the chamber 13*b* from the outside by the reciprocation of the piston Pb. Note that the piston Pd arranged within the cylinder 10*d* have the similar structure. Thus, air is introduced in the crankcase 20 from the outside by the reciprocation of these pistons.

As illustrated in FIG. 6, the check valve V2 is arranged between the distal end of the piston rod 21*b* and the piston head 25*b*. Thus, when the distal end of the check valve V2 is elastically deformed to be bent away from the through-hole 26*b*, the distal end of the check valve V2 abuts with a bottom surface of the recess portion 23*b*, so that the check valve V2 is restricted from being further elastically deformed. Thus, the maximum amount of the elastic deformation of the check valve V2 is restricted to a certain amount. For example, when the great elastic deformation is repeated in such a check valve V2, the durability of the check valve might deteriorates. Also, when the check valve is deformed greatly, it might be plastically deformed to exceed its elastic limit, so that the through-hole cannot be closed adequately. Thus, the performance of the check valve might deteriorate. In the present embodiment, the check valve V2 is arranged between the piston rod 21*b* and the piston head 25*b*, and the elastic deformation amount is restricted by the piston rod 21*b*. This can suppress the deterioration in the performance of the check valve V2 caused by a too large amount of the elastic deformation.

Also, the through-hole 22*b* releases the screw S2 fixing the check valve V2 to the piston head 25*b*. Specifically, the through-hole 22*b* is formed coaxially with the screw S2 so as not to interfere with a head portion of the screw S2 protruding to the space SP. Thus, regardless of the protruding amount of the screw S2, the thickness of the space SP can be designed. Therefore, for example, the thickness of the space SP can be designed smaller than that of the head portion of the screw S2, and the total thickness of the distal end of the piston rod 21*b* and the piston head 25*b* can be designed small.

Also, the through-hole 26*b* is formed a such a position as to release the head portion of the screw S1 protruding into the chamber 13*b*. Therefore, the screw S1 avoids interfering with the piston head 25*b*. Thus, even if the head portion of the screw S1 protrudes into the chamber 13*b*, the through-hole 26*b* releases the head portion of the screw S1, so the minimum of the capacity of the chamber 13*b* can be small as much as possible, thereby ensuring the ratio of the maximum to the minimum of the capacity of the chamber 13*b*. This can further introduce air into the crankcase 20.

While the exemplary embodiments of the present invention have been illustrated in detail, the present invention is not limited to the above-mentioned embodiments, and other embodiments, variations and modifications may be made without departing from the scope of the present invention.

What is claimed is:

1. A piston drive device comprising:

a crankcase;

first and second compression cylinders fixed to the crankcase;

first and second vacuum cylinders fixed to the crankcase;

a rotational shaft rotatably supported within the crankcase;

first and second compression pistons connected to the rotational shaft and reciprocating respectively within the first and second compression cylinders; and first and second vacuum pistons connected to the rotational shaft and reciprocating respectively within the first and second vacuum cylinders, wherein:

each diameter of piston heads of the first and second compression pistons is smaller than each diameter of piston heads of the first and second vacuum pistons, the first and second compression pistons are connected to the rotational shaft so as to sandwich the first and second vacuum pistons in an axial direction of the rotational shaft, reciprocation of the first vacuum piston introduces air into the crankcase, and reciprocation of the second vacuum piston introduces air into the crankcase, and within the crankcase, air introduced into the crankcase by the first vacuum piston is mixed with air introduced into the crankcase by the second vacuum piston.

2. The piston drive device of claim 1, wherein first and second compression chambers are respectively formed within the first and second compression cylinders, capacities of the first and second compression chambers are increased and decreased by reciprocation of the first and second compression pistons, respectively, first and second vacuum chambers are respectively formed within the first and second vacuum cylinders, capacities of the first and second vacuum chambers are increased and decreased by reciprocation of the first and second vacuum pistons, respectively, the first and second compression pistons compress air introduced into the first and second compression chambers and discharge air outside the first and second compression chambers, respectively, and the first and second vacuum pistons discharge air, introduced into the first and second vacuum chambers, outside the first and second vacuum chambers, respectively.

3. The piston drive device of claim 1, wherein there is a virtual plane being perpendicular to the rotational shaft and intersecting the piston heads of the first and second compression pistons and the first and second vacuum pistons.

4. The piston drive device of claim 1, further comprising an outer rotor type motor driving the rotational shaft.

* * * * *